US008145462B2

(12) United States Patent
Foucault

(10) Patent No.: US 8,145,462 B2
(45) Date of Patent: Mar. 27, 2012

(54) FIELD SYNTHESIS SYSTEM AND METHOD FOR OPTIMIZING DRILLING OPERATIONS

(75) Inventor: Hubert Foucault, Evry (FR)

(73) Assignee: Halliburton Energy Services, Inc., Houston, TX (US)

( * ) Notice: Subject to any disclaimer, the term of this patent is extended or adjusted under 35 U.S.C. 154(b) by 619 days.

(21) Appl. No.: 11/106,966

(22) Filed: Apr. 15, 2005
(Under 37 CFR 1.47)

(65) Prior Publication Data

US 2005/0267719 A1 Dec. 1, 2005

(30) Foreign Application Priority Data

Apr. 19, 2004 (GB) ..... 0408697.1

(51) Int. Cl.
*G06G 7/48* (2006.01)

(52) U.S. Cl. ..... 703/10; 702/6; 702/9

(58) Field of Classification Search ..... 703/10; 702/9, 11, 27, 34, 172, 6; 175/40
See application file for complete search history.

(56) References Cited

U.S. PATENT DOCUMENTS

| | | | | |
|---|---|---|---|---|
| 1,209,299 | A | 12/1916 | Hughes | |
| 1,263,802 | A | 4/1918 | Reed | |
| 1,394,769 | A | 10/1921 | Sorensen | |
| 3,593,807 | A | 7/1971 | Klima | 173/6 |
| 3,660,649 | A | 5/1972 | Gilchrist et al. | 235/193 |
| 3,752,966 | A | 8/1973 | Foy et al. | 175/40 |
| 3,761,701 | A | 9/1973 | Wilder et al. | 235/193 |
| 3,971,449 | A | 7/1976 | Nylund et al. | 173/11 |
| 4,056,153 | A | 11/1977 | Miglierini | 175/376 |
| 4,064,749 | A | 12/1977 | Pittman et al. | 73/152 |
| 4,096,385 | A | 6/1978 | Marett | 702/8 |
| 4,195,699 | A | 4/1980 | Rogers et al. | 713/177 |
| 4,354,233 | A | 10/1982 | Zhukovsky et al. | 173/6 |
| 4,407,017 | A | 9/1983 | Zhilikov et al. | 173/6 |
| 4,479,176 | A | 10/1984 | Grimshaw | 364/148 |
| 4,617,825 | A | 10/1986 | Ruhovets | 73/152.05 |
| 4,627,276 | A | 12/1986 | Burgess et al. | 175/39 |

(Continued)

FOREIGN PATENT DOCUMENTS

DE 3207012 12/1983

(Continued)

OTHER PUBLICATIONS

H. Foucault, M. Kieng, and G. B. Boe, "An Integrated Drilling Optimization for Faster and Higher Improvements in Oseberg South", 2003, Society of Petroleum Engineering Inc.*

(Continued)

*Primary Examiner* — Kamini S Shah
*Assistant Examiner* — Kibrom Gebresilassie
(74) *Attorney, Agent, or Firm* — Baker Botts L.L.P.

(57) ABSTRACT

A system and method for optimizing the performance of a drilling device utilizes well logs and drilling parameters from multiple offset wells located in proximity to the location of a desired wellbore. The well logs and drilling parameters data from the offset wells is synthesized to determine major drilling contexts including both geological trends, mechanical properties and the different well profiles. The performance of one or more drilling devices and or drilling parameters is then simulated within the selected drilling contexts of the offset wells. The simulation information is then used to select an optimized drilling device or parameter for drilling the selected wellbore.

43 Claims, 6 Drawing Sheets

U.S. PATENT DOCUMENTS

| | | | | |
|---|---|---|---|---|
| 4,646,240 | A | 2/1987 | Serra et al. | 364/422 |
| 4,679,174 | A * | 7/1987 | Gelfand | 367/73 |
| 4,685,329 | A | 8/1987 | Burgess | 175/39 |
| 4,694,686 | A | 9/1987 | Fildes et al. | 324/71 |
| 4,718,011 | A | 1/1988 | Patterson, Jr. | 364/422 |
| 4,758,956 | A | 7/1988 | Duffy | 364/422 |
| 4,793,421 | A | 12/1988 | Jasinski | 173/11 |
| 4,794,534 | A | 12/1988 | Millheim | 175/40 |
| 4,794,535 | A | 12/1988 | Gray et al. | 364/420 |
| 4,845,628 | A | 7/1989 | Gray et al. | 702/9 |
| 4,852,399 | A | 8/1989 | Falconer | 73/151.5 |
| 4,875,530 | A | 10/1989 | Frink et al. | 175/27 |
| 4,876,886 | A | 10/1989 | Bible et al. | 73/151.5 |
| 4,903,527 | A | 2/1990 | Herron | 702/8 |
| 4,914,591 | A | 4/1990 | Warren et al. | 364/422 |
| 4,916,616 | A | 4/1990 | Freedman et al. | 364/422 |
| 4,926,686 | A | 5/1990 | Fay | 175/39 |
| 4,926,950 | A | 5/1990 | Zijsling | 175/39 |
| 4,928,521 | A | 5/1990 | Jardine | 73/152.43 |
| 4,981,037 | A | 1/1991 | Holbrook et al. | 166/250 |
| 5,010,789 | A | 4/1991 | Brett et al. | 700/159 |
| 5,012,674 | A | 5/1991 | Millheim et al. | 324/201 |
| 5,042,596 | A | 8/1991 | Brett et al. | 175/57 |
| 5,205,164 | A | 4/1993 | Steiger et al. | 702/9 |
| 5,216,612 | A | 6/1993 | Cornett et al. | 364/468 |
| 5,216,917 | A | 6/1993 | Detournay | 175/39 |
| 5,239,467 | A | 8/1993 | Kelly et al. | 364/421 |
| 5,251,286 | A | 10/1993 | Wiener et al. | 395/22 |
| 5,282,384 | A | 2/1994 | Holbrook | 702/12 |
| 5,305,836 | A | 4/1994 | Holbrook et al. | 175/26 |
| 5,318,136 | A | 6/1994 | Rowsell et al. | 175/24 |
| 5,330,016 | A | 7/1994 | Paske et al. | |
| 5,334,833 | A | 8/1994 | Case et al. | 250/270 |
| 5,369,570 | A | 11/1994 | Parad | 364/401 |
| 5,415,030 | A | 5/1995 | Jogi et al. | 175/39 |
| 5,416,697 | A * | 5/1995 | Goodman | 702/9 |
| 5,442,950 | A | 8/1995 | Unalmiser et al. | 73/152 |
| 5,449,047 | A | 9/1995 | Schivley, Jr. | 173/11 |
| 5,458,207 | A | 10/1995 | Mattero | 173/6 |
| 5,461,562 | A | 10/1995 | Tabanou et al. | 364/422 |
| 5,474,142 | A | 12/1995 | Bowden | 175/27 |
| 5,539,704 | A | 7/1996 | Doyen et al. | 367/73 |
| 5,608,162 | A | 3/1997 | Ho | 73/152.48 |
| 5,654,938 | A | 8/1997 | Tang et al. | 367/34 |
| 5,660,239 | A | 8/1997 | Mueller | 175/61 |
| 5,704,436 | A | 1/1998 | Smith et al. | 173/6 |
| 5,767,399 | A | 6/1998 | Smith et al. | 702/10 |
| 5,784,333 | A | 7/1998 | Tang et al. | 367/30 |
| 5,794,720 | A | 8/1998 | Smith et al. | 175/40 |
| 5,842,149 | A * | 11/1998 | Harrell et al. | 702/9 |
| 5,845,258 | A | 12/1998 | Kennedy | 705/8 |
| 5,870,690 | A * | 2/1999 | Frenkel et al. | 702/7 |
| 5,878,372 | A | 3/1999 | Tabarovsky et al. | 702/7 |
| 5,963,910 | A | 10/1999 | Ulwick | 705/7 |
| 5,965,810 | A | 10/1999 | Holbrook | 166/254 |
| 6,021,859 | A | 2/2000 | Tibbitts et al. | 175/431 |
| 6,026,912 | A | 2/2000 | King et al. | |
| 6,044,327 | A | 3/2000 | Goldman | 702/11 |
| 6,052,649 | A | 4/2000 | Goldman et al. | 702/11 |
| 6,058,073 | A * | 5/2000 | VerWest | 367/31 |
| 6,073,079 | A * | 6/2000 | Thomas | 702/9 |
| 6,109,368 | A | 8/2000 | Goldman et al. | 175/39 |
| 6,131,673 | A | 10/2000 | Goldman et al. | 175/40 |
| 6,155,357 | A | 12/2000 | King et al. | |
| 6,169,967 | B1 | 1/2001 | Dahlem et al. | 703/10 |
| 6,233,498 | B1 | 5/2001 | King et al. | |
| 6,276,465 | B1 * | 8/2001 | Cooley et al. | 175/24 |
| 6,349,595 | B1 * | 2/2002 | Civolani et al. | 73/152.02 |
| 6,374,926 | B1 | 4/2002 | Goldman et al. | 175/39 |
| 6,389,360 | B1 | 5/2002 | Alft et al. | 702/9 |
| 6,408,953 | B1 * | 6/2002 | Goldman et al. | 175/39 |
| 6,424,919 | B1 | 7/2002 | Moran et al. | 702/6 |
| 6,516,293 | B1 | 2/2003 | Huang et al. | 703/10 |
| 6,612,382 | B2 * | 9/2003 | King | 175/40 |
| 6,654,692 | B1 * | 11/2003 | Neff | 702/11 |
| 6,785,641 | B1 * | 8/2004 | Huang | 703/7 |
| 6,856,910 | B2 * | 2/2005 | Goswami et al. | 702/10 |
| 6,879,947 | B1 | 4/2005 | Glass | 703/10 |
| 6,950,786 | B1 * | 9/2005 | Sonneland et al. | 703/2 |
| 7,003,439 | B2 * | 2/2006 | Aldred et al. | 703/10 |
| 7,032,689 | B2 * | 4/2006 | Goldman et al. | 175/39 |
| 7,035,778 | B2 * | 4/2006 | Goldman et al. | 703/10 |
| 7,085,696 | B2 * | 8/2006 | King | 703/10 |
| 7,139,689 | B2 * | 11/2006 | Huang | 703/7 |
| 7,184,991 | B1 | 2/2007 | Wentland et al. | 706/45 |
| 7,261,167 | B2 * | 8/2007 | Goldman et al. | 175/39 |
| 7,357,196 | B2 * | 4/2008 | Goldman et al. | 175/24 |
| 7,369,979 | B1 * | 5/2008 | Spivey | 703/8 |
| 7,526,413 | B2 * | 4/2009 | Dahlberg | 703/2 |
| 7,953,585 | B2 * | 5/2011 | Gurpinar et al. | 703/10 |
| 2001/0042642 | A1 * | 11/2001 | King | 175/40 |
| 2002/0103630 | A1 | 8/2002 | Aldred et al. | 703/10 |
| 2002/0120401 | A1 | 8/2002 | Macdonald et al. | 702/6 |
| 2002/0120429 | A1 * | 8/2002 | Ortoleva | 703/2 |
| 2003/0015351 | A1 * | 1/2003 | Goldman et al. | 175/39 |
| 2004/0000430 | A1 * | 1/2004 | King | 175/24 |
| 2004/0059554 | A1 * | 3/2004 | Goldman et al. | 703/7 |
| 2004/0133531 | A1 * | 7/2004 | Chen et al. | 706/8 |
| 2004/0138819 | A1 * | 7/2004 | Goswami et al. | 702/10 |
| 2004/0143427 | A1 * | 7/2004 | Huang et al. | 703/10 |
| 2004/0182606 | A1 * | 9/2004 | Goldman et al. | 175/39 |
| 2004/0254664 | A1 * | 12/2004 | Centala et al. | 700/97 |
| 2005/0037929 | A1 * | 2/2005 | Kirsner et al. | 507/103 |
| 2005/0096847 | A1 * | 5/2005 | Huang | 702/9 |
| 2006/0155475 | A1 * | 7/2006 | Yin | 702/14 |
| 2006/0167668 | A1 * | 7/2006 | Cariveau et al. | 703/7 |
| 2009/0164186 | A1 * | 6/2009 | Haase et al. | 703/10 |
| 2011/0161133 | A1 * | 6/2011 | Staveley et al. | 705/7.28 |

FOREIGN PATENT DOCUMENTS

| | | |
|---|---|---|
| DE | 3704077 | 8/1987 |
| EP | 0384734 A | 8/1990 |
| EP | 0466255 | 1/1992 |
| EP | 0840141 | 10/1997 |
| FR | 2611804 | 2/1987 |
| GB | 2241266 | 8/1991 |
| GB | 2265923 | 10/1993 |
| GB | 2328467 | 2/1999 |
| GB | 2328966 | 3/1999 |
| GB | 2332227 | 6/1999 |
| GB | 2343905 | 5/2000 |
| GB | 2354852 | 4/2001 |
| GB | 2360304 | 9/2001 |
| GB | 2363144 | 12/2001 |
| GB | 2363145 | 12/2001 |
| GB | 2363146 | 12/2001 |
| GB | 2364083 | 1/2002 |
| GB | 2365899 | 2/2002 |
| GB | 2370059 | 6/2002 |
| GB | 2370060 | 6/2002 |
| GB | 2371321 | 7/2002 |
| GB | 2371366 A | 7/2002 |
| GB | 2378017 | 1/2003 |
| NL | 1020253 | 11/2003 |
| RU | 1795220 | 2/1993 |
| RU | 1796769 | 2/1993 |
| RU | 1231946 | 11/1995 |
| SU | 470593 | 8/1975 |
| SU | 479866 | 8/1975 |
| SU | 726295 | 4/1980 |
| SU | 983258 | 12/1982 |
| SU | 1654515 | 3/1988 |
| SU | 1691497 | 5/1988 |
| SU | 1479630 | 5/1989 |
| SU | 1716112 | 2/1992 |
| WO | 91/14214 | 9/1991 |
| WO | 0012859 | 3/2000 |
| WO | 0012860 | 3/2000 |
| WO | 02/50571 | 6/2002 |
| WO | 2006024865 | 3/2006 |

OTHER PUBLICATIONS

H. Foucault, M. Lieng, G. Borg Boe, G. Skofteby, and J. E. Utvik, "An Integrated Drilling Optimization for Faster and Higher Improvements in Oseberg South", pp. 1-8, 2003.*

Mature Assets, Boosting Mature Asset Recovery While Lowering Costs, Halliburton Brochure, 8 pages, Dec. 2004.
Ma Dekun et al., The Operation Mechanics of the Rock Bit, Petroleum Industry Press, pp. 1-238, 1996.
W.W. Reynolds, Economic Analysis of Drilling Plans and Contractors by Use of a Drilling Systems Approach, Journal of Petroleum Technology pp. 787-793, Jul. 1986.
E.M. Galle and H.B. Woods, "Best Constant Weight and Rotary Speed for Rotary Rock Bits", API Drilling and Production Practice, .pp. 48-73, 1963.
R. Teale, "The Concept of Specific Energy in Rock Drilling", International Journal of Rock Mechanics, Mining Sciences, vol. 2, , Great Britain, pp. 57-63, 1965.
R.V. Barragan, O.L.A. Santos and E.E. Maidla, "Optimization of Multiple Bit Runs", SPE/IADC 37644, pp. 579-589, Mar. 4, 1977.
Doveton, J.D. et al., "Fast Matrix Methods for the Lithological Interpretation of Geophysical Logs", Geomathematical and Petrophysical Studies in Sedimentology; 17 pgs., Jul. 1978.
Howell Word and Marvin Fisbeck, "Drilling Parameters and the Journal Bearing Carbide Bit", Drilling—DCW, , first published Oct. 1979 in Tulsa, Oklahoma pp. 92-93, Jan. 1980.
R.C. Pessier, M.J. Fear, "Quantifying Common Drilling Problems With Mechanical Specific Energy and A Bit-Specific Coefficient of Sliding Friction", SPE Paper 24584, Washington, D.C. pp. 373-388, Published Oct. 1982.
Michael A. Simpson, Sr., "Hand-Held Calculator Program Helps Optimize Drilling", World Oil, pp. 97-101, Apr. 1984.
T.M. Burgess, W.C. Lesso, "Measuring the Wear of Milled Tooth Bits Using MWD Torque and Weight-On-Bit", SPE/IADC 13475, published Mar. 1985, New Orleans, Louisiana, pp. 453-458 for pages illustration, Mar. 1985.
Kenneth L. Mason, "3-Cone Bit Selection With Sonic Logs", SPE Drilling Engineering, first published Sep. 1984 in Houston, Texas, SPE 13256, pp. 135-142, Jun. 1987.
Allen D. Gault, "Measurement of Drilling Properties", SPE Drilling Engineer, published New Orleans, Lousiana, Mar. 1985, pp. 143-148, Jun. 1987.
European Search Report for EP03021140.3; 6 pages, Feb. 4, 2004.
French Preliminary Report for application No. FR 0203948. 5 pages, Nov. 21, 2003.
French Prelinimary Report for application No. FR 0503786, 2 pages, Jun. 29, 2006.
Dr. Alan J. Scott, "Online Animations of Time Evolving Physical Systems", Depart of Physics, University of Wisconsin-Stout, Printed May 4, 2004.
G. Martin Milner and Glen Corser, "Data Processing and Interpretation While Drilling", AADE National Drilling Technical Conference, 2001.
Jim O'Hare and Osarumwense O.A. Aigbekaen Jr., "Design Index: A Systematic Method of PDC Drill-Bit Selection", IADC World Drilling, 2000.
J Booth and M.M. Cook, "Meeting Future Drilling Planning and Decision Support Requirements: A New Drilling Simulator", SPE/IADC Drilling Conference, 2001.
P.R. Rampersad, G. Hareland and P. Boonyapaluk, "Drilling Optimization Using Drilling Data and Available Technology", Society of Petroleum Engineers, Inc., 1994.
Foucault, Hubert et al., "An Integrated Drilling Optimazation for Faster and Higher Improvements in Oseberg South", Halliburton Energy Services; Hydro, 8 pages, 2003.
W.W. Reynolds, "*Economic Analysis of Drilling Plans and Contractors by Use of a Drilling Systems Approach*", Journal of Petroleum Technology, XP-002261288, pp. 787-793, Jul. 1986.
M.R. Fassihi et al., "*Risk Management for the Development of an Offshore Prospect*", SPE 52975, XP-002261289, pp. 1-6, Mar. 20, 1999.
I.C. Pallister et al., "Asset Optimization Using Multiple Realizations and Streamline Simulation", Society of Petroleum Engineers—SPE 59460, Apr. 25, 2000.
Tom H. Hill et al., "*Drilling Optimization: Practice makes perfect*!", World Oil vol. 220, No. 4, XP-000831749, pp. 63-64, 66, and 68, Apr. 1999.
Ali G. Kadaster et al., "*Drilling Time Analysis—A TQM Tool for Drilling in the '90s*", Petroleum Engineer International vol. 65, No. 2, XP 000349995, pp. 31-32, 35-38, Feb. 1993.
Wilson C. Chin, "*Wave Propagation in Petroleum Engineering*" (1994).
Brochure entitled: "*Twist & Shout*", Smith International, Inc., (SB2255.1001), 4 pages, Printed Jun. 2004.
Adam T. Bourgoyne Jr et. al., "*Applied Drilling Engineering*", Society of Petroleum Engineers Textbook Series (1991).
J. P. Nguyen, "*Oil and Gas Field Development Techniques: Drilling*" (translation 1996, from French original 1993), 1996.
"*Making Hole*", part of Rotary Drilling Series, edited by Charles Kirkley (1983).
"*Drilling Mud*", part of Rotary Drilling Series, edited by Charles Kirkley (1984).
H.G. Benson, "*Rock Bit Design, Selection and Evaluation*", presented at the spring meeting of the pacific coast district, American Petroleum Institute, Division of Production, Los Angeles, May, 1956.
J.C. Estes, "*Selecting the Proper Rotary Rock Bit*", Journal of Petroleum Technology, Nov. 1971, pp. 1359-1367.
Sikarskie, et. al., "*Penetration Problems in Rock Mechanics*", American Society of Mechanical Engineers, Rock Mechanics Symposium, (1973).
Dykstra, et. al., "*Experimental Evaluations of Drill String Dynamics*", Amoco Report No. SPE 28323, (1994).
Kenner and Isbell, "*Dynamic Analysis Reveals Stability of Roller Cone Rock Bits*", SPE 28314, (1994).
Bassiouni, Z., "Theory, Measurement, and Interpretation of Well Logs"; Richardson, TX 1994; 23 pgs.
Computer Processing of Log Data Improves Production in Chaveroo Field; pp. 889-895; *Journal of Petroleum Technology* , Jul. 1967.
K.K. Millheim, "The Role of the Simulator in Drilling Operations", SPE Drilling Engineering, Oct. 1986.
Doveton, John D.; "Geologic Log Analysis Using Computer Methods" *AAGP Computer Applications in Geology*, No. 2; 30 pgs., 1994.
Harris, Martin H et al., "A Computer-Oriented Generalized Porosity-Lithology Interpretation of Neutron, Density and Sonic Log", 10 pgs., Feb. 1971.
Rider, Malcom; *The Geological Interpretation of Well Logs*, Second Edition; Gulf Publishing, Houston, 35 pgs., 1996.
Schlumberger Log Interpretation Principles/Applications: *Schlumberger Educational Services*; 15 pgs., 1991.
Dewan, John T.; "Essentials of Moder Open-Hole Log Interpretation", pp. 210227, NL Industries Inc., 1983.
Sheppard, M.C et al., "Forces at the Teeth of a Drilling Rollercone Bit: Theory and Experiment", Proceedings: 1988 SPE Annual Tehnical Conference and Exhibition; vol. Delta, pp. 253-260, XP002266080, Oct. 2, 1988.
Chambers, Robert et al., "Drilling Man's Guide to Better Bit Selection", Petroleum Engineer, pp. 100-108, Jun. 1982.
Novig, T., "Factors Affecting Rock Bit Selection", Oil Gas Magazine, Apr. 1988.
Soemodihardjo, W. et al., "Application of an Expert System to Rotary Drilling Bit Selection", 1st Victorian Dep. of Manufacturing Ind. Dev., pp. II-17 through II-40, Nov. 1991.
Dfendiyev, G.M. et al., "The Optimum Decision in Cutting-Type Drilling Bits Selection with Regard to their Operating Conditions and the Vagueness of the Task Pose", Energy Sources, vol. 13, pp. 243-250, 1991.
"Advanced Bit Engineering, Selection Lowers Drilling Cost", Petroleum Engineer No. 9, vol. 65, p. 3, Sep. 1993.
Falcao, J.L. et al., "PDC Bit Selection through Cost Prediction Estimates Using Crossplots and Sonic Log Data", SPE/IADC 25733, pp. 525-535, 1993.
Pessier, R.C. et al., "Different Shales Dictate Fundamentally Different Strategies in Hydraulics, Bit Selection, and Operating Practices", SPE 28322, pp. 307-318, 1994.
Tewari, Shrikant, "Dull Bit Grading and Rock Strength Analysis Key to Bit Selection", Oil & Gas Journal, pp. 45-51, Dec. 5, 1994.
Hameed A. et al., "Deep Wells Bit Optimization", SPE/IADC 39269, pp. 197-203, 1997.
Perrin, V.P. et al, "Drilling-Index—A New Approach to Bit Performance Evaluation", SPE/IADC 37595, pp. 199-205, 1997.

De Castro, F.J.N. et al., Evaluation of Drill Bit Performance Taking into Account the in Situ State of Stress, SPE International, pp. 1-8, 1997.
Fabian, Robert T., "In Situ Compressive Strength Analysis as an Aid in Fixed Cutter Bit Selection and Performance", ASME International, pp. 86-94, 1997.
Xu, H.. et al., "A Method for Bit Selection y Modeling ROP and Bit-Life", The Petroleum Society, Paper 97-78, p. 1-8, Jun. 8, 1997.
Dekun, Ma et al., "Computer Simulation of the Interaction between Roller Bit and Rock", Proceedings of the International Meeting on Petroleum Engineering, Part 1 of 2; vol. 1, pp. 309-317; XP002266077, 1995.
Franco, Victor Hugo. "Introduction to Wireline Log Analysis", Western Atlas International, Houston; pp. 185-231, 1992.
Crain, E.R.; "The Log Analysis Handbook, Volume One: Quantative Log Analysis Methods", PennWell. Tulsa, OK, 1986.
Prammer, M.G. et al., "Measurements of Clay-Bound Water and Total Porosity by Magnetic Resonance Logging", SPE paper 36522, 1996.
Oort, Eric Van, "Physico-Chemical Stabilization of Shales", SPE paper 37623, 1996.
Smith, L. et al., "Successful Field Application of an Electro-Negative 'Coating' to Reduce Bit Balling Tendencies in Water Based Mud", SPE/IADC paper 35110, 1996.
Glover, et al., "New Advances and Applications of Combining Simulation and Optimization", Proc. Winter Simulation Conference, pp. 144-152, Dec. 1996.
Hill et al., "Intelligent Drilling System for Geological Sensing", Proc. of the 1EEE/RSJ Int. Conf. on Intelligent Robots and Systems, vol. 1. pp. 495-501, Jul. 1993.
Hancke et al., "A Control System for Optimizing Deep Hole Drilling Conditions", Proc. IECON Inter. Conf. on Industrial Electronics, Control and Instrument, vol. 3, pp. 2279-2284, Nov. 1991.
Murphy, Don; "Selecting the Right Rotary Bit is the Place to Smart Cutting Costs", The Oils & Gas Journal, pp. 88-92, Feb. 3, 1969.
Jackson, R.A.; "Cost/Foot: Key to Economic Selection of Rock Bits", World Oil. pp. 83-85, Jun. 1972.
Estes, Jack C.; "Guidelines for Selecting Rotary Insert Rock Bit", Petroleum Engineer, pp. 30-34, Sep. 1974.
Warren, T.M.; "Factors Affecting Torque for a Roller Cone Bit", JPT J PET Technol., vol. 36, No. 10, pp. 1500-1508; XP002266079, Jun. 1989.
Philip Holbrook, Michael Hauck, "Petrophysical—Mecahnical Math Model Real-Time Wellsite Poor Pressure/Fracture Gradient Prediction", SPE Pub. No. 16666, published Sep. 1987 in Dallas, Texas.
E.C. Onyia, "Relationships between Formation Strength, Drilling Strength, and Electric Log Properties", SPE Drilling Engineering, pp. 605-618, Oct. 1988.
David A. Glowka, "Use of Single-Cutter Data in the Analysis of PDC Bit Designs: Part I—Development of a PDC Cutting Force Model", JPT, pp. 797-849, Aug. 1989.
David A. Glowka, "Use of Single-Cutter Data in the Analysis of PDC Bit Designs: Part II—Development of PDC WEAR Computer Code", JPT, pp. 850-859, Aug. 1989.
Steklyanov, A.V. et al., "Improving the Effectiveness of Drilling Tools", KhM-3 Oil Industry Machine Building, Moscow, pp. 1-35, 1991.
E. Detournay, P. Defourny, "A Phenomenological Model for the Drilling Action of Drag Bits", International Journal of Rock Mechanics, Mineral Sciences and Geomechanical Abstracts, vol. 29, No. 1, printed in Great Britain, pp. 13-23, 1992.
Joe Kelly, Jr., "Use break-Even Analysis to Optimize Bit Runs", World Oil, pp. 75-79, Nov. 1992.
Geir Hareland and L.L. Hoberock, "Use of Drilling Parameters to Predict In-Situ Stress Bounds", SPE/IADC 25727, pp. 457-471, Feb. 1993.
J.P.R. Sparr and L.W. Ledgerwood, harvey Goodman, R.L. Graff and T.J. Moo, "Formation Compressive Strength Estimates for Predicting Drillability and PDC Bit Selection", SPE/IADC 29397, Amsterdam, Netherlands, pp. 569-578, Published Feb. 1995.
R.K. Bratli, G. Hareland, F. Stene, G.W. Dunsaed and G. Gjelstad, "Drilling Optimization Software Verified in the North Sea", SPE 39007, 7 pages, Aug. 1997.
E.T. Koskie, Jr., P.Slagel and W. Lesso, Jr., "Monitoring MWD Torque Improved PDC Bit Penetration Rates", World Oil, pp. 61-67, 1998.
Gjelstad, G. Hareland, K.N. Nikolaisen and R.K. Bratli, "The Method of Reducing Drilling Costs More Than 50 Percent", SPE 47342, 7 pages, Jul. 1998.
M.B. Ziaja and J.C. Roegiers, "Lithology Diagnosis Based on the Measurements of Drilling Forces and Moments at the Bit", IADC/SPE 47799, pp. 185-194, Sep. 1998.
Xu, T. Hatakeyama, T. Yonezawa and A. Suzuki, "Evaluation of Bit Performance Using an Advanced Drilling-Test System", IADC/SPE 47809, pp. 247-252, Sep. 1998.
H.I. Bilgesu, U. Altmis, S. Ameri, S. Mohaghegh andK. Aminian, "A New Approach to Predict Life Based on Tooth or Bearing Failures", SPE 51082, pp. 253-257, Nov. 1998.
Baker Hughes "Oasis" available from http://www.bakerhughes.com/bakerhughes/Oasis/OASIS%20brochure.5.pdf (10 pages), 2001.
Dutch Search Report for NL Application No. 1020253 (10 pages), Nov. 14, 2003.
Great Britain Search Report for GB Application No. 0408697.1 (3 pages), Oct. 19, 2004.
Memorandum Opinion of Judge Davis, signed Feb. 13, 2004, in the United States District Court for the Eastern District of Texas, Sherman Division, Civil Action No. 4-02CV269, *Halliburton Energy Services, Inc.* v. *Smith International, Inc.*, 37 pages (including fax coversheet), Feb. 19, 2004.

* cited by examiner

*FIG. 3*

| 110 WELL ID/ BIT NAME | 112 GLOBAL AVERAGES | 114 av. IN 15-40Kpsi | 116 av. IN LIMESTONE | 118 DEVIATION |
|---|---|---|---|---|
| 120 WELL 10<br>122 BIT C<br>124 MD 387<br>TVD 281 | av.CCS 13Kpsi<br>126 135<br>128 av.ROP 13.2m/h<br>130 av.WOB 103KN<br>av.RPM 131 | net thickness 151<br>net/gross 39% 134<br>av.ROP 8.3m/h 136<br>av.WOB 126KN 138<br>av.RPM 130 140 | net thickness 171 142<br>av.CCS 21Kpsi 144<br>142 | DEVIATION 44-73° |
| 120 WELL 9<br>122 BIT B<br>124 MD 684<br>TVD 372 | av.CCS 12Kpsi<br>132<br>126 135<br>128 av.ROP 6.3m/h<br>av.WOB 107KN<br>av.RPM 146 130 | net thickness 152<br>net/gross 22% 134<br>av.ROP 2.5m/h 136<br>av.WOB 179KN 138<br>av.RPM 143 140 | net thickness 160<br>av.CCS 24Kpsi 144 | DEVIATION 54-65° |
| WELL 8<br>BIT C<br>MD 1320<br>TVD 490 | av.CCS>13Kpsi<br>132<br>Top N/A<br>av.ROP 22.0m/h<br>av.WOB 136KN<br>av.RPM 147 | net thickness 332<br>net/gross 25%<br>av.ROP 13.8m/h<br>av.WOB 181KN<br>av.RPM 142 | net thickness 308<br>av.CCS 25Kpsi | DEVIATION 78° |
| WELL 7<br>BIT B, BIT A<br>MD 3116<br>TVD 344 | av.CCS>12Kpsi<br>Top N/A<br>av.ROP 16.2m/h<br>av.WOB 108KN<br>av.RPM 150 | net thickness 767<br>net/gross 25%<br>av.ROP 9.2m/h<br>av.WOB 128KN<br>av.RPM 157 | net thickness 932<br>av.CCS 22Kpsi | DEVIATION 85-70° |
| WELL 6<br>BIT B<br>MD 510<br>TVD 329 | av.CCS>10Kpsi<br>Top N/A<br>av.ROP 18.7m/h<br>av.WOB 113KN<br>av.RPM 122 | net thickness 80<br>net/gross 16%<br>av.ROP 8.0m/h<br>av.WOB 156KN<br>av.RPM 122 | net thickness 121<br>av.CCS 20Kpsi | DEVIATION 45-65° |
| WELL 5<br>BIT A<br>BR#2<br>MD sup1221<br>TVD sup350 | av.CCS 13Kpsi<br>av.ROP 12.0m/h<br>av.WOB 115KN<br>av.RPM 140 | net thickness 371<br>net/gross 30%<br>av.ROP 6.6m/h<br>av.WOB 135KN<br>av.RPM 138 | net thickness 358<br>av.CCS 22Kpsi | DEVIATION 73° |
| WELL 4<br>BIT A<br>MD 615<br>TVD 271 | av.CCS 6Kpsi<br>av.ROP 30.2m/h<br>av.WOB 78KN<br>av.RPM 139 | net thickness 36<br>net/gross 6%<br>av.ROP 22.4m/h<br>av.WOB 96KN<br>av.RPM 138 | net thickness 109<br>av.CCS 13Kpsi | DEVIATION 64° |

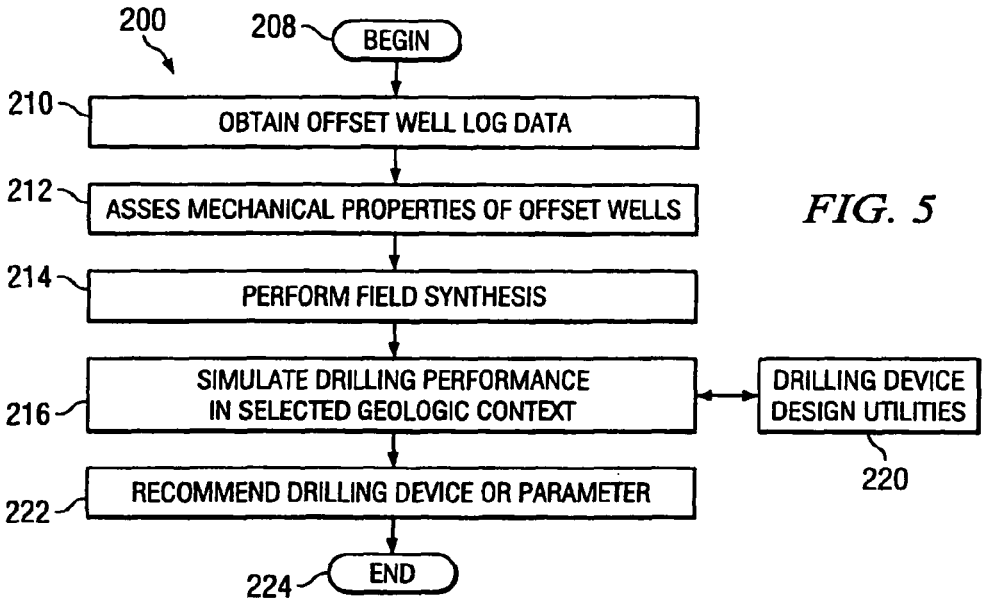
FIG. 5
FIG. 7
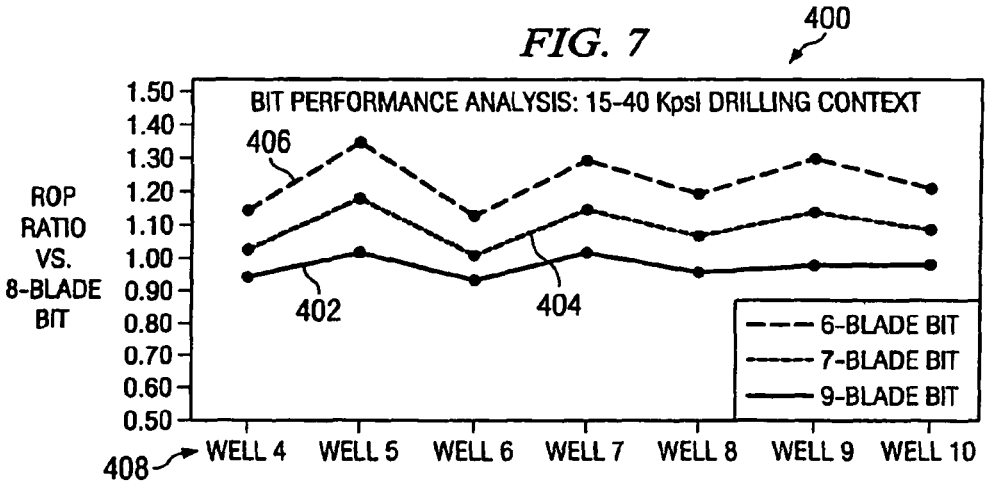
FIG. 8
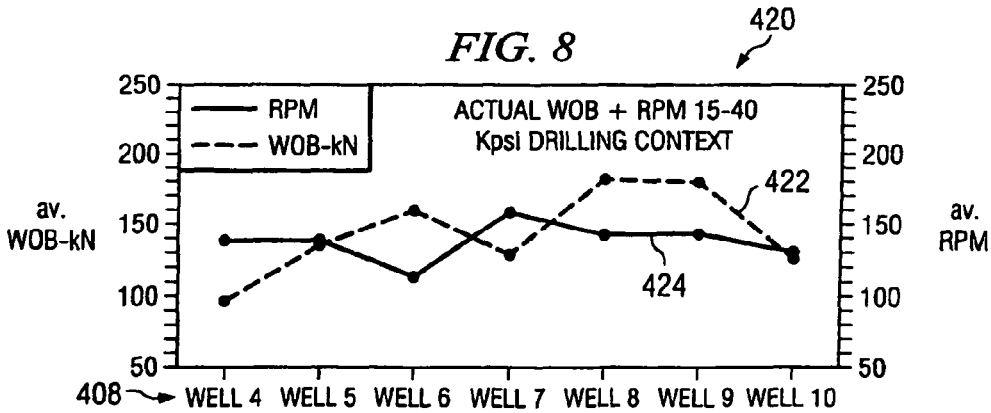

FIG. 9
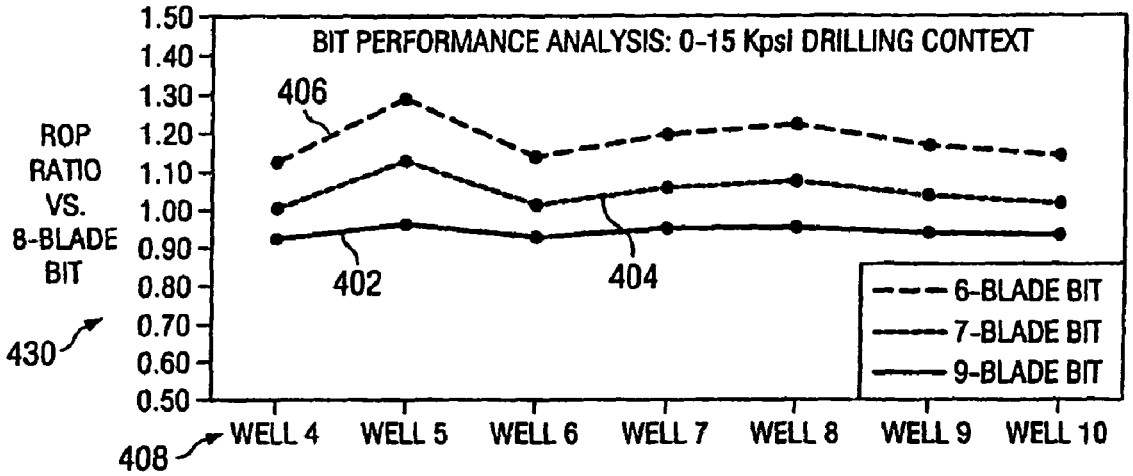
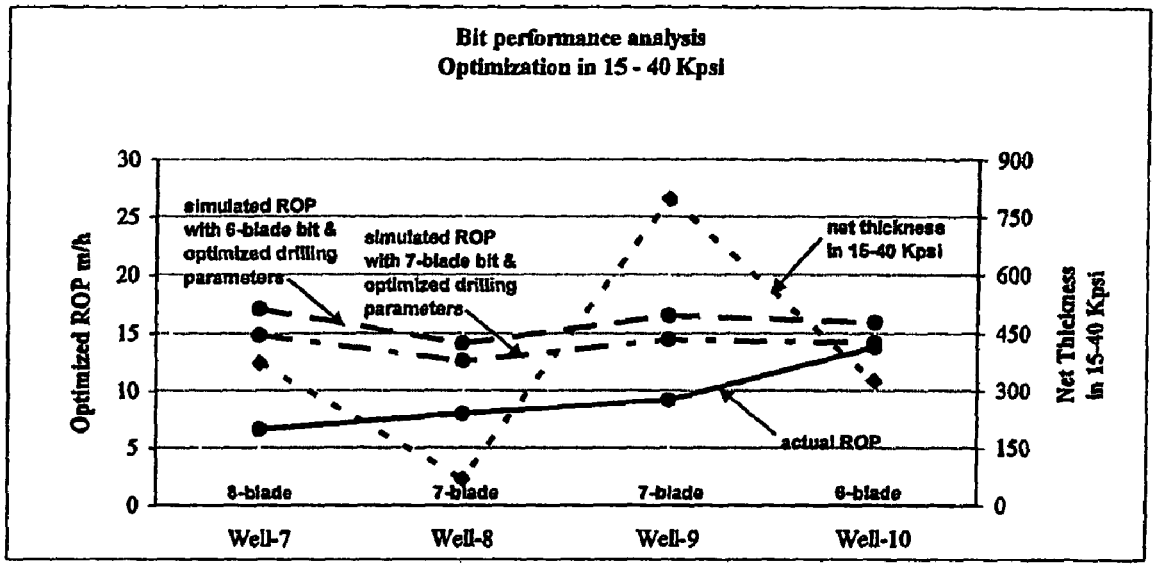
FIG. 10
FIG. 11
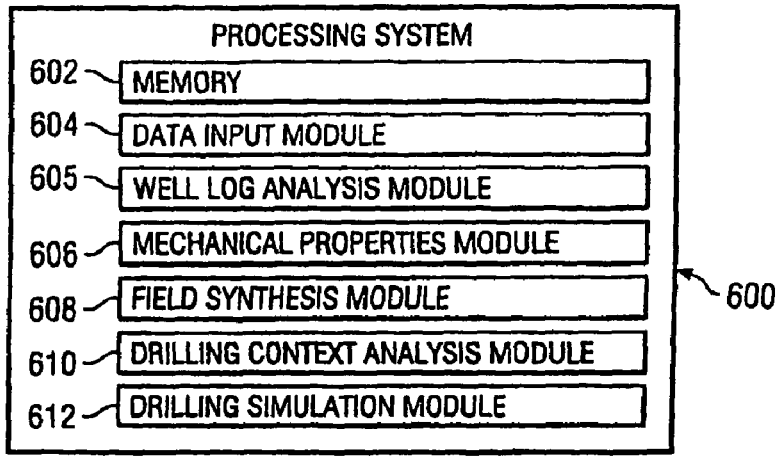

FIELD SYNTHESIS SYSTEM AND METHOD FOR OPTIMIZING DRILLING OPERATIONS

FOREIGN PRIORITY

This application claims foreign priority to British Application Patent Number 04 086 97.1 filed Apr. 19, 2004.

TECHNICAL FIELD OF THE INVENTION

The present invention relates in general to systems, methods and techniques for drilling wellbores and more specifically to a field synthesis system and method for optimizing drilling operations.

BACKGROUND OF THE INVENTION

One significant challenge faced in the drilling of oil and gas wells is predicting the future drilling performance of a drilling system. There are a number of downhole conditions and/or occurrences which can be of great importance in determining how to proceed with an operation, including selecting drilling devices and operating parameters that will be used in a particular drilling operation.

In many situations multiple wells are drilled within a single field. When drilling a new wellbore within such a field, log data from a nearby "offset" well data is often used to select the drilling equipment and drilling parameter that will be used to drill the new wellbore. This typically involves comparing the performance of drilling devices (typically in terms of average rate of penetration (ROP)) that were used to drill the offset wells. Over the course of the development of the field, drilling device selection and drilling parameter selection gradually improves. This gradual improvement, sometimes referred to as a "learning curve", is typically slower than desired often requiring drilling ten or more wells to identify optimal drilling devices and drilling parameters. Additionally, the use of overall drilling performance in offset wells may provide spurious inferences where a field has significant lithology, mechanical property, and thickness variations. In such situations, the use of data from an offset well is often an inaccurate indicator of whether a particular drilling device was the best selection for drilling a particular wellbore.

Accordingly, such information is often of limited value in predicting how a particular drilling device or how particular drilling equipment will perform in fields with significant variations in lithology and mechanical properties. Such use of offset well data in fields with variations in lithology often results in the selection of drilling devices and drilling parameters that are not optimized. Such non-optimized selections result in increased drilling times and increased cost.

SUMMARY OF THE INVENTION

Therefore, a need has arisen for a method and system for optimizing drilling device performance in fields with significant variations in lithology or mechanical properties.

A further need exists for a method and system for optimizing drilling parameters for wells drilled in fields with significant variations in lithology or mechanical properties. In accordance with teachings of the present disclosure, a system and method are described for optimizing the performance of a drilling device that reduces or eliminates many of the problems associated with previously developed methods and systems. The disclosed system and method for optimizing the performance of a drilling device utilizes well logs and drilling parameters from multiple offset wells located in proximity to the location of a desired wellbore. The logs from the offset wells are synthesized to determine major drilling contexts including both geological trends, mechanical properties and the different well profiles. The predicted lithology and well profile of the selected wellbore are then divided into multiple drilling contexts. The performance of one or more drilling devices and or drilling parameters is then simulated within the selected drilling contexts of the offset wells. Offset drilling contexts and predicted drilling contexts are then compared. The simulation information is then used to select an optimized drilling device or parameter for drilling the selected wellbore.

Additionally, the simulation data can be used to modify the design of the drilling device and to optimize its performance while drilling the selected wellbore. Such real time optimization provides significant advantages over previous techniques. Such real time optimization includes evaluating drilling contexts and actual drilling contexts using MWD or LWD in real time. In this manner, offset drilling contexts as well as drilling device and drilling parameters may be analyzed and selectively modified during the drilling of the selected wellbore.

In one aspect a method is disclosed that optimizes the performance of a drilling device for drilling a selected wellbore. The method includes obtaining well logs from three or more offset wells that are associated with the selected wellbore. The well logs from the offset wells are then synthesized. The synthesized well log data is then evaluated within multiple drilling contexts. Finally the performance of the drilling device is simulated in one or more of the drilling contexts of the offset wells. In a particular embodiment the performance of a first drill bit and a second (or more) drill bit are simulated and the results of the simulation are then compared against one another to determine the drill bit that will achieve optimum performance for a new wellbore.

In another aspect a method is disclosed for optimizing one or more drilling parameters that are used to drill a selected wellbore using a selected drilling device. The method includes obtaining well logs from three or more offset wells that are associated with the selected wellbore. The well logs are then synthesized and divided into multiple drilling contexts. A drilling context is then selected for predicting drilling performance in a new well. Simulations are then performed of the drilling device using a first set of drilling parameters and using a second (or more) set of drilling parameters within the select drilling context. The predicted performances are then compared to determine the optimum parameters for drilling the desired well.

In another aspect, a system for optimizing the performance of a drilling device for drilling a selected well bore includes a well log analysis module having mechanical properties evaluation capabilities, a field synthesis module, a context analysis module, and a drilling simulation module. The well log analysis module receives well logs from three or more offset wells located in proximity to the selected well bore. The field synthesis module then synthesizes the well logs from the at least three offset wells. The drilling context analysis module acts to divide the predicted lithology and well profile of the selected well bore into multiple drilling contexts. The simulation module then simulates the performance of a selected drilling device or drilling parameter in the selected drilling contexts of the offset wells.

The present disclosure includes a number of important technical advantages. One important technical advantage is synthesizing well logs from three or more offset wells. This allows for the determination of which drilling context are key in the optimization of a drilling device or drilling parameters, especially in fields that have significant variation in lithology and mechanical properties. Another important technical advantage is separating the predicted lithology and well profile of the selected wellbore that is to be drilled into multiple drilling contexts. This allows for a detailed analysis to occur within drilling contexts that are likely to be critical to the overall drilling performance of the selected wellbore. Additional advantages of the present invention will be apparent to those of skill in the art in the FIGURES description and claims herein.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 3 is a table showing drilling information and formation and mechanical properties information related to multiple wells drilled within a single field;

FIG. 5 shows a flow diagram of a method for simulating drilling performance using synthesized offset well data;

FIG. 7 shows the performance of multiple different drill bits for drilling operations within a selected drilling context;

FIG. 8 shows the variation in drilling parameters used to drill a series of wellbores in a field within a selected drilling context;

FIG. 9 shows the performance of three drill bits in a second selected drilling context within a field;

FIG. 10 shows a performance analysis for multiple wells using teachings of the present disclosure in a selected critical drilling context; and FIG. 11 is a diagram of a system for optimizing the performance of a drilling device according to teachings of the present disclosure.

DETAILED DESCRIPTION OF THE INVENTION

Preferred embodiments and their advantages are best understood by reference to FIGS. 1-10 wherein like numbers are used to indicate like and corresponding parts.

Figure 1:
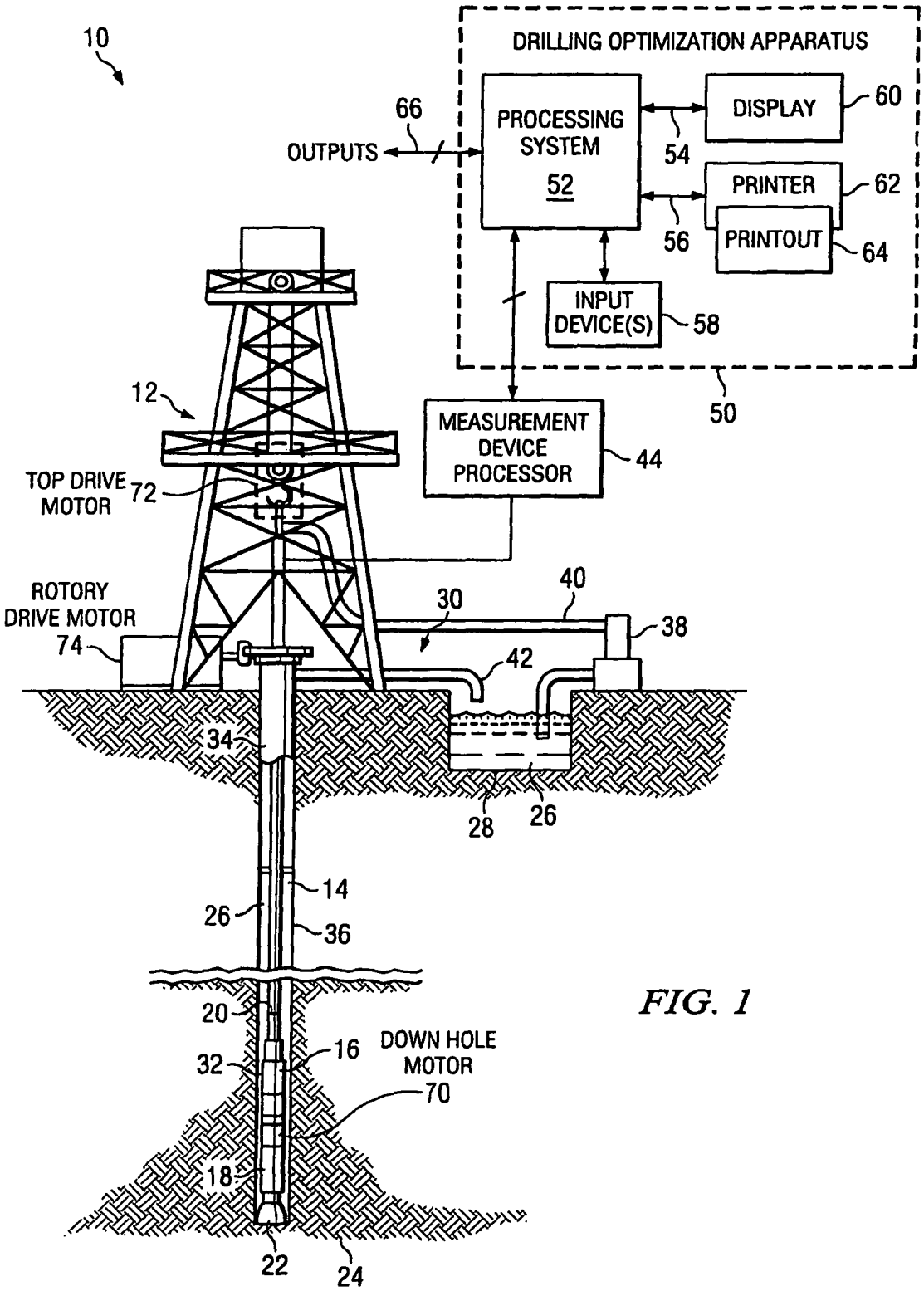
FIG. 1 is a drilling system according to teachings of the present disclosure.

Now referring to FIG. 1, a drilling system depicted generally at 10 includes a drilling rig 12 disposed atop a borehole 14. A logging tool 16 is carried by a sub 18, typically a drill collar, incorporated into a drill string 20 and disposed within the borehole 14. A drill bit 22 is located at the lower end of the drill string 20 and carves a borehole through earth formations 24. Drilling mud 26 is pumped from a storage reservoir pit 28 near the wellhead 30, down an axial passageway (not expressly shown) through the drill string 20, out of apertures in drill bit 22 and back to the surface through annular region 32. Metal casing 34 is positioned in borehole 14 above drill bit 22 for maintaining the integrity of an upper portion of borehole 14. Drilling system 10 also includes equipment such as downhole motor 70, top drive motor 72 and rotary table motor 74 to provide power to the system.

Annular region 32 is located between drill string 20, sub 18 and sidewalls 36 of borehole 14 and forms the return flow path for the drilling mud. Mud is pumped from storage pit 28 near wellhead 30 by pumping system 38. Mud travels through mud supply line 40 which is coupled to a central passageway extending throughout the length of drill string 20. Drilling mud is pumped down drill string 20 and exits into borehole 14 through apertures in drill bit 22 that act to cool and lubricate the bit and carry formation cuttings produced during the drilling operation back to the surface. Fluid exhaust conduit 42 connects with annular passageway 32 at the wellhead for conducting the return flow of the mud from borehole 14 to mud pit 28. Drilling mud is typically handled and treated by various apparatus (not expressly shown) such as outgassing units and circulation tanks for maintaining a preselected mud viscosity and consistency.

Logging tool or instrument 16 can be any conventional logging instrument such as acoustic (sometimes referred to as sonic), neutron, gamma ray, density, photoelectric, nuclear magnetic resonance, or any other conventional logging instrument, or combinations thereof which can be used to measure the lithology or porosity of formations surrounding an earth borehole.

Because the logging instrument is embedded in the drill string 20 the system is considered to be a measurement while drilling (MWD) system that logs while the drilling process is underway. The logging data can be stored in a conventional downhole recorder which can be accessed at the surface when drill string 20 is retrieved, or it can be transmitted to the surface using telemetry such as conventional mud pulse telemetry systems. In either case logging data from logging instrument 16 is provided to processor 44 to be processed for use in accordance with the embodiments of the present disclosure as provided herein.

In alternate embodiments wire line logging instrumentation may also be used in addition to the MWD instrumentation described above. Typically with wire line instrumentation, a wire line truck (not shown) is typically situated at the surface of the wellbore. A wire line logging instrument is suspended in the borehole by a logging cable which passes over a pulley and a depth measurement sleeve. As the logging instrument traverses the borehole it logs the formation surrounding the borehole as a function of depth. Logging data is then transmitted through the logging cable to a processor (such as processor 44) located at or near the logging truck to process the logging data as appropriate for use with the instruments of the present disclosure. As with MWD systems, the wire line instrumentation may include any conventional logging instrumentation which can be used to measure the lithology and/or porosity of formations surrounding an earth borehole, such as: acoustic, neutron, gamma ray, density, photoelectric, nuclear magnetic resonance, or any other conventional logging instrument or accommodations thereof which can be used to measure the lithology.

In the present embodiment, apparatus 50 preferably optimizes the performance of drilling system 10 for drilling a selected wellbore in a given formation 24 is shown. In the present preferred embodiment, drilling prediction system 50 is remotely located with respect to drilling rig 12. Data from drilling rig 12 and other offset wells may be transmitted to system 50 via a network connection or may be physically uploaded via a storage medium such as a diskette, CD-ROM or the like.

Prediction apparatus 50 may include any suitable geology and drilling mechanics simulation models and further includes optimization and prediction modes of operation discussed further herein. Prediction apparatus 50 further includes a device 52 (which will be referred to herein as a "processing system") that may include any suitable commercially available computer, controller, or data processing apparatus, further being programmed for carrying out the method and apparatus as further described herein.

In a preferred embodiment, the offset well log data received by processing system that is associated with borehole 14 and other offset well data may include, for example well logs that incorporate caliper, Gamma Ray, Spectral Gamma Ray, Resistivitiy, Spontaneous Potential, Sonic, Neutron and Density, Photoelectric, and NMR data. Well log data may further include survey-deviation, UTM coordinates, and information from mud logs including geologic and formation tops information. The offset well log data may further include drilling data such as: bit performance data, bit Records, and drilling parameters such as rate of penetration (ROP), weight on bit (WOB), revolutions per minute (RPM), torque, flow rate. Drilling data may also include stand pipe pressure, gas, and mud weight Processing system 52 includes at least one input for receiving input information (for instance, such as well log data as described above) and/or commands from any suitable input device, or devices 58. Input device 58 may include a keyboard, keypad, pointing device or the like. Input device 58 may further included a network interface or other communications interface for receiving input information from a remote computer or database. Input devices may be used for inputting specifications of proposed drilling equipment or drilling parameters for used in a simulation of drilling a new wellbore.

Processing system 52 also includes at least one output 66 for outputting information signals. In the present embodiment, output signals can also be output to a display device 60 via communication line 54 for use in generating a display of information contained in the output signals. Output signals can also be output to a printer device 62, via communication line 56, for use in generating a print-out 64 of information contained in the output signals.

Processing system 52 is preferably programmed to perform the functions as described herein using program techniques known to those skilled in the art. In a preferred embodiment processing system 52 preferably includes a computer readable medium having executable instructions stored thereon for carrying out the steps described herein. Processing system may incorporate a commercial computing platform such as Openworks and Insite offered by Halliburton or another suitable computing platform. In some embodiments, processing system may incorporate different modules for carrying out the different steps or processes described in FIG. 11, herein.

In the present embodiment, processing system 52 operates to synthesize well logs from multiple offset wells. The drilling performance of the selected wellbore are synthesized by first collecting data from offset wells. The data is preferably selected in order to be significant for the next field development. Next the lithology, porosity, mechanical properties are evaluated. Next, multiwell statistical studies are conducted in order to determine the geological field trends. The field trends may include variations of lithology, mechanical properties, thickness, depth of formation, and dips in function of the well location. The statistical studies may include, for instance: averages, histograms for dispersion evaluation, cross sections, cross plots graphs to study the correlation between a set of parameters, and mappings. Such field synthesis is akin to the field synthesis process is commonly applied to reservoir evaluation. However such evaluation has heretofore been limited to the analysis of petrophysical properties such as saturation, porosity, and permeability. In contrast, the field synthesis directed by processing system 52 analyzes offset well data using formation and drilling data, characteristics, and parameters likely to be critical in terms of drilling performance. In preferred embodiments bit performances are analyzed as a function of the detailed formation properties and as a function of the physical properties of the well such as diameter, deviation and direction, often referred to as the "well profile."

The synthesized field data preferably factors in the variations in lithology and formation thickness that can be determined from the variations between the different offset wells. This is particularly advantageous in fields that have significant variations in lithology, mechanical properties and formation thickness.

Additionally, processing system 52 is operable to divide the offset well data into multiple drilling contexts. A Drilling context, for the purposes of this disclosure may include geologic contexts and well profiles. For the purposes of this disclosure, a geologic context may include any discretely defined drilling environment. For example, a geologic context may include portions of a drilling environment that have rock strength of a given interval (such as a having a rock strength between 15 Kpsi and 40 Kpsi. In other embodiments, geologic contexts may include drilling environments defined by formation type, plasticity, porosity, or abrasivity. In a one embodiment, the geologic contexts may be selectively modified by a user or operator of the system. In another embodiments, the drilling contexts may constitute standardized ranges of different drilling environments.

In this manner, processing system 52 allows a user to analyze the synthesized field data to determine whether a particular context is likely to effect drilling performance. The objective of the field synthesis process is to define and evaluate the major drilling context which will be used for the next step of the simulation and drilling optimization. Drilling contexts that are determined to have a critical influence of drilling performance may be referred to herein as a critical context.

Processing system 52 is also operable to simulate drilling of an offset well or analyze the log data using a suitable simulation model of analysis technique. For instance, processing system 52 may incorporate a lithology model as described in U.S. Pat. No. 6,044,327, issued Mar. 28, 2000, entitled "METHOD AND SYSTEM FOR QUANTIFYING THE LITHOLOGIC COMPOSITION OF FORMATIONS SURROUNDING EARTH BOREHOLES" and incorporated herein by reference. Processing system 52 may also incorporate a rock strength model as described in U.S. Pat. No. 5,767,399, issued Jun. 16, 1998, entitled "METHOD OF ASSAYING COMPRESSIVE STRENGTH OF ROCK" and incorporated herein by reference.

Additionally, Processing system 52 may also incorporate a shale plasticity model as described in U.S. Pat. No. 6,052,649, issued Apr. 18, 2000, entitled "METHOD AND SYSTEM FOR QUANTIFYING SHALE PLASTICITY FROM WELL LOGS" and incorporated herein by reference. Processing system 52 may also incorporate a mechanical efficiency model as described in U.S. Pat. No. 6,131,673, issued Oct. 17, 2000, entitled "METHOD OF ASSAYING DOWNHOLE OCCURRENCES AND CONDITIONS" and incorporated herein by reference.

For performing simulations, processing system 52 may also incorporate a bit wear model as described in U.S. Pat. No. 5,794,720, issued Aug. 18, 1998, entitled "METHOD OF ASSAYING DOWNHOLE OCCURRENCES AND CONDITIONS" and incorporated herein by reference. Processing system 52 may also incorporate a penetration rate model as described in U.S. Pat. No. 5,704,436, issued Jan. 16, 1998, entitled "METHOD OF REGULATING DRILLING CONDITIONS APPLIED TO A WELL BIT" and incorporated herein by reference.

In a preferred embodiment, after a drilling context of interest has been identified, a simulation of the drilling of the offset wells is performed using different drilling devices or drilling parameters. Subsequent simulations may then be performed by varying parameters of the drilling devices or using modified drilling parameters. For instance, in simulating the performance of a drill bit, drill bit design parameters such as number of blades, cutter type, bit profile, sharp slope, dull slope, friction slope, wear exponent, max work, initial contact area, and final contact area may be selectively adjusted and compared with the simulated performance of other drill bits.

Such simulations are preferably performed by processing system 52 for a selected drilling context. In particular preferred embodiments, this simulation may be performed for one or more drilling contexts that have been selected as a critical drilling context. As further described herein, the simulation operations performed by processing system 52 for a given series of offset wells may be performed with respect to multiple drilling devices, such as multiple drill bits. In other embodiments, the simulations performed by processing system may be performed for a selected drilling device using different drilling parameters such as different values for weight on bit (WOB) and revolutions per minute (RPM). In still other embodiments, a simulation may be performed for a selected drilling device such as a selected drill bit. The results of the simulation may then be analyzed and the attributes of the bit (such as bit profile, number of cutters, cutter size and other suitable parameters) may be modified. The performance of the modified drill bit may then be simulated and compared with the performance of the original bit.

Figure 2:
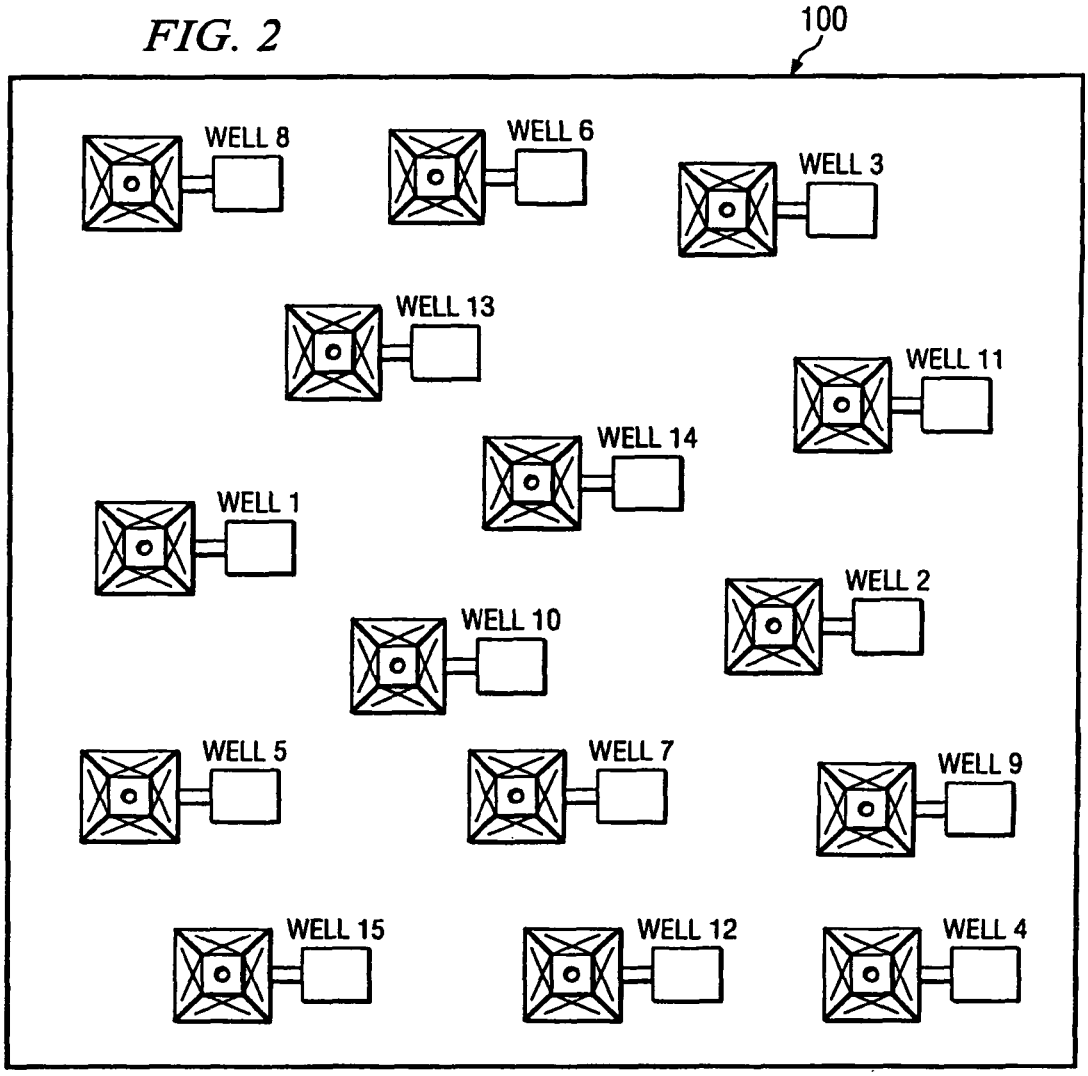
FIG. 2 is a diagram showing the locations of multiple wells within a single field.

Now referring to FIG. 2, a depiction of drilling field 100 is shown. As shown, drilling field 100 includes wells 1-14 drilled within the field. In the present example embodiment, drilling field 100 contains variations in geologic formations and variations in the thickness and the mechanical properties of those formations and variations of the well profiles.

Now referring to FIG. 3, a table 105 showing geologic and drilling information related to wells 4-10 is shown. Column 110 of table lists the well identification 120, drill bit identification 122, and depth information 124 (both measured depth (MD) and true vertical depth (TVD) values). Column 112 of table 105 includes global averages for compressive rock strength 126, ROP 128, WOB 130, and RPM 132. In the present embodiment, column 114 of table 105 shows drilling information for a particular geologic context of the present well bore. For this example, the geologic context of compressive strength between 15 and 40 Kpsi was determined to be of interest. Accordingly, data for each well in the selected context is listed in column 114 including net thickness of geologic context 134, net/gross value 135, ROP 136, WOB 138, and RPM 140. Net/gross value 135 represents the ratio of the total thickness is made up of the drilling context at issue.

The table also includes data related to each well in a limestone context in column 116. Column 116 lists a net thickness value 142 and average compressive strength value for the limestone context of each well. Lastly, column 118 lists the deviation of each well. Deviation may be considered because mechanical properties commonly vary as a function of deviation. Additionally, deviation values are preferably taken into account in defining well profile as discussed above.

Figure 4:
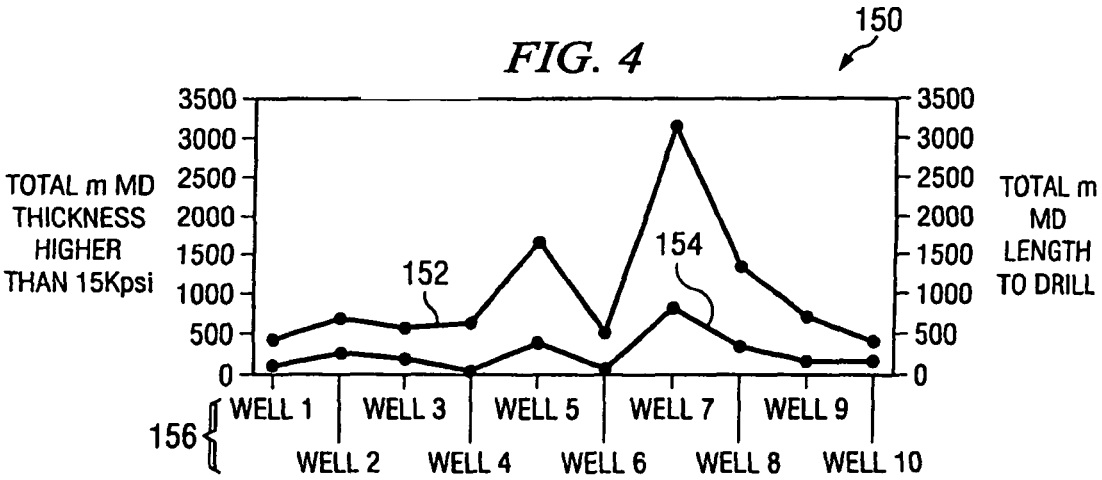
FIG. 4 is a graph showing variations in drilling conditions for different wells in a single field for identifying and analyzing drilling contexts according to teachings of the present disclosure.

As shown in table 105, the thickness of the 15-40 Kpsi context and the drilling performance therein varies significantly between the wells, both in net thickness 134, and as a proportion of depth of the total well 114. FIG. 4 shows a graphical representation 150 of the total depth 152 relative to the thick in the selected geologic context (compressive strength between 15 and 40 Kpsi) 154 of the wells 156. As shown in graph 150, the absolute depths 152 as well as the thickness of the geologic context of interest 154 varies from well to well.

Now referring to FIG. 5, a flow diagram depicted generally at 200 shows a method according to the present invention. The method begins 208 by collecting data from offset wells 210. In the present embodiment, offset well data must be obtained for at least three offset wells that are located in proximity to the location of the new well that is desired to be drilled. In some embodiments, data from between six and twelve offset wells may be obtained and considered in the method described herein. For the purposes of this disclosure, an offset well may be considered to be any well located within the same field as the well that is desired to be drilled and whose lithology and drilling data may (in combination with information from other offset wells) be useful in the prediction of the drilling performances of the new well to be drilled.

Next the mechanical properties, in this example—rock strength, of the formations of the three or more offset wells are assessed 304. The rock strength assessment may be performed using a rock strength model as described in U.S. Pat. No. 5,767,399 or any other suitable rock strength model. Next the rock strength data from the offset wells is synthesized 306. This step may also be referred to as the field synthesis step.

The synthesized field data is then analyzed and one of more drilling contexts of interest are selected. The performance of a drilling device (or of multiple drilling devices) with one or more drilling parameters is then simulated for the select drilling context or contexts 216. In the present example embodiment, a simulation is run for the selected drilling device at specified drilling parameters for each of the individual offset wells. Simulation is limited to a simulation within the selected drilling context.

After completion of the simulation, the performance of the different drilling devices or drilling parameters is analyzed and the design of the drilling device (in this case a fixed cutter drill bit) is modified using drilling design utilities 220. In some embodiments drilling design utilities may be associated with an Application Design Engineer or another operator to facilitate the modifications to the drill bit design. The performance of the modified drilling device may then be simulated for the desired wellbore and compared with the original or unmodified drilling device. The process may be repeated until an optimized drill bit has been identified. The optimized drilling device or parameter is then recommended 222 and the method ends 224 until the desired the desired wellbore is drilled and a subsequent wellbore is desired to be drilled in the field.

In one preferred embodiment, during the drilling of the new wellbore, well logs from the new well bore may be analyzed in real time. This real time analysis may include comparing the performance of the actual performance of the drilling device with the predicted performance of the drilling device. The predicted performance of the drilling device is preferably previously determined utilizing a well prognosis of the new wellbore. The wellbore profile typically includes the expected geology of the wellbore.

As the new wellbore is drilled, the performance of the selected drilling device using the selected drilling parameter may be compared with the anticipated performance for the portion of the wellbore that has been drilled. In the event that the actual performance deviates significantly from the predicted performance, the actual drilling data may be re-synthesized with the existing offset well data to determine whether drilling device selection or drilling parameters should be modified to optimize the drilling of the well. In many cases this may involve re-evaluating the selection of the critical context for the new wellbore.

In some embodiments drilling performance simulation 216 is performed for multiple drilling devices such as multiple different drill bits. In other alternate embodiments drilling simulation step 216 is performed for a given or selected drilling device using multiple different drilling parameters such as weight-on-bit and RPM.

Figure 6:
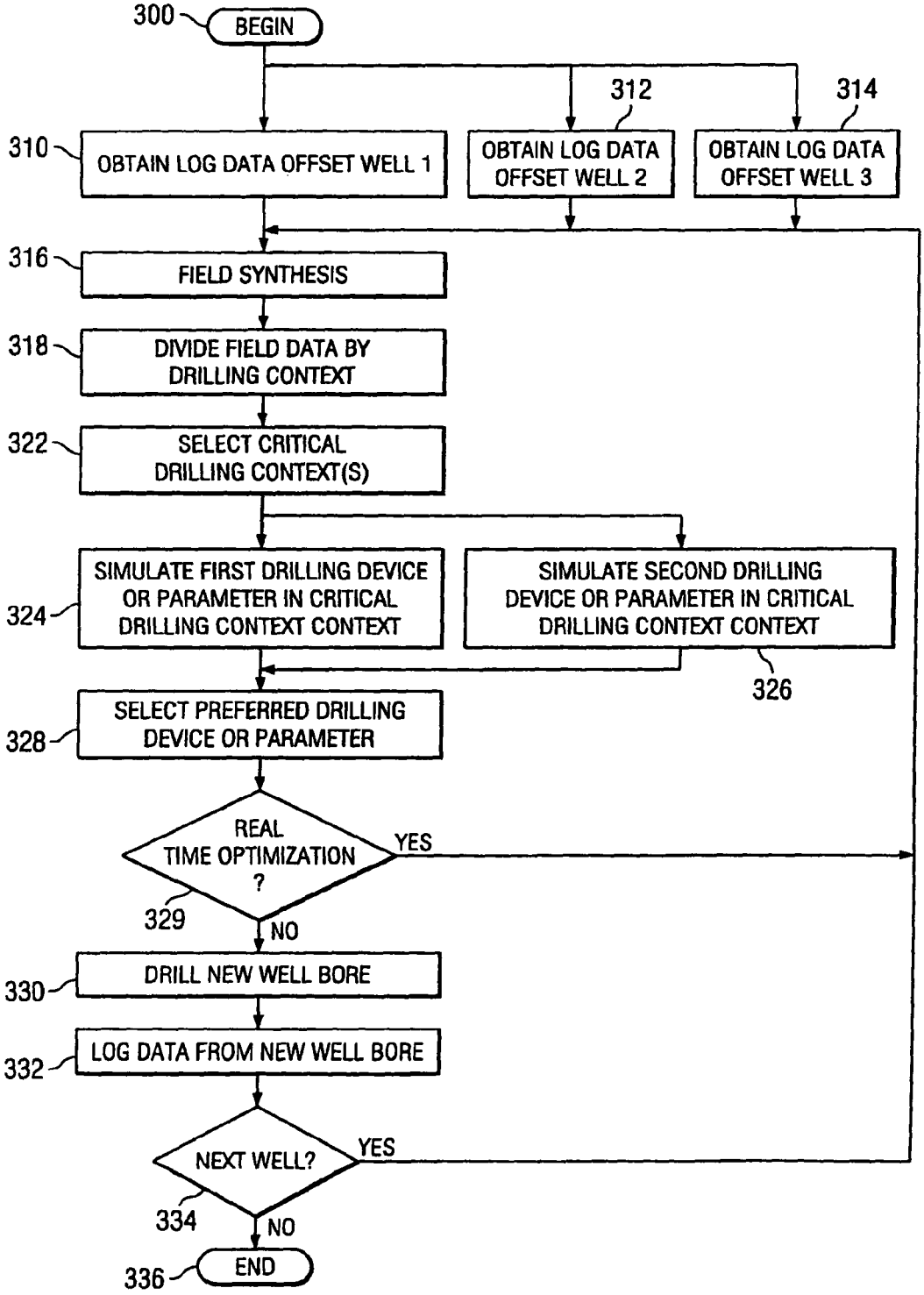
FIG. 6 is a flow diagram showing a method for optimizing drilling performance according to the present disclosure.

FIG. 6 is a flow chart showing a method, beginning at step 300 for synthesizing data from multiple offset wells to optimize drilling device and drilling parameters for a selected well. Initially, log data is obtained from at least three offset wells 310, 312, and 314. In alternate and subsequent embodiments, data from additional wells may preferably be considered. The offset log data is then preferably synthesized 316, as described above. Next the synthesized field data is divided into different drilling contexts for analysis 318. The different drilling contexts are then analyzed and the critical drilling context (or contexts) is selected 322.

After the selection of one or more critical drilling context, simulations 324 and 326 are performed for a selected different drilling devices or drilling parameters are run for the critical drilling context(s) of the offset wells. Additional simulations (for instance, for additional drilling devices or drilling parameters) may be also be run. The simulated drilling performance is then analyzed to select an optimized drilling device or drilling parameters 328. Following selection of an optimized drilling device it is determined whether the drilling performance of the new wellbore is to optimized in real time. If so, then during the drilling of the new wellbore, the actual drilling performance may be compared with the predicted drilling performance of the new wellbore. If the actual drilling performance deviates significantly (in a negative manner) from the predicted performance, the evaluation and selection of drilling contexts may be reconsidered. This may include incorporating drilling data that is obtained in real time or substantially in real time during the drilling of the new wellbore (as in steps 300 and 332 below) into field synthesis and using the newly obtained data to perform a new iteration of the present method.

If real time optimization is declined, the wellbore is drilled 330 and appropriate log data is collected 332. If additional wells are to be drilled in the field 334, the log data is included with the existing log data 310, 312, and 314 to update and optimize drilling device and drilling parameter selection for the new well. Otherwise, the method concludes 336.

FIG. 7 shows a graphical comparison 400 of multiple drill bits within a geologic context of rock strength from 15-40 Kpsi. The present example analysis shows the rate of penetration ratio for a nine blade fixed cutter drill bit 402, a seven-blade fixed cutter drill bit 404, and a six blade fixed cutter drill bit 406 as compared with an eight blade fixed cutter drill bit. As shown in the present example embodiment, in each well 408 shown six blade bit 406 is predicted to have a higher penetration rate compared with the seven blade bit 404. Seven blade bit 404, in turn, performs superior to nine blade bit 402.

FIG. 8 shows a graphical representation 420 of WOB and RPM values for the 15-40 Kpsi context, that were used in drilling wells 408. As shown, in the actual drilling of wells 408, the values of WOB 422 and RPM 424 were not constant in the drilling of the wells.

FIG. 9 shows a graphical comparison 430 of multiple drill bits within a geologic context of rock strength from 0-15 Kpsi. The present example analysis shows the rate of penetration ratio for a nine blade fixed cutter drill bit 402, a seven-blade fixed cutter drill bit 404, and a six blade fixed cutter drill bit 406 as compared with an eight blade fixed cutter drill bit. As shown in this example embodiment (and similar to the embodiment of FIG. 7), in each well 408 shown the six blade bit 406 is predicted to have a higher penetration rate compared with the seven blade bit 404. Additionally, the seven blade bit 404 is predicted to perform superior to nine blade bit 402.

FIG. 10 is a graphical representation of an example field optimization. The graph shows the net thickness of the selected critical context—in this example, the portion of each well having a rock strength of 15-40 Kpsi. The graph also shows the optimized, predicted performance for a six-blade fixed cutter drill bit and a seven blade fixed cutter drill bit as well as the actual performance of each drill bit that was use to drill each well. The first well shown (well 5) was drilled with an eight blade bit. Well 6 and Well 7 were subsequently drilled with a seven blade bit at which time the gap between the actual drilling performance and the optimized drilling performance for either the seven blade bit or the six blade bit is reduced. This performance gap is further reduced when Well 8 is drilled with a six blade bit. As demonstrated, the field synthesis method for optimizing drilling operations give a much faster and steeper learning curve than existing methods.

FIG. 11 is a processing system 600 for optimizing the performance of a drilling device for drilling a selected well bore. Processing system 600 includes memory 602 which may be used to store log data or other lithology data from offset wells received by data input module 604. Processing system 600 also includes well log analysis module 605, mechanical properties assessment module 606, field synthesis module 608, drilling context analysis module 610, and drilling simulation module 612. Well log analysis 605 processes the well log data. Mechanical properties assessment module 606 acts to determine characteristics of the offset wells from the received offset well data such as rock strength, abrasivity, shale plasticity. Field synthesis module 608 synthesizes the log data from multiple offset wells as described above.

Drilling context analysis module 610 divides offset wells into multiple drilling contexts to assist in identification of one or more critical drilling contexts. Simulation module 612 acts to simulate the performance of one or more selected drilling devices in the at least one selected drilling context.

Although the disclosed embodiments have been described in detail, it should be understood that various changes, substitutions and alterations can be made to the embodiments without departing from their spirit and scope.

What is claimed is:

1. A method for optimizing the performance of a drilling device for drilling a selected well bore in a drilling field comprising:

obtaining well logs and drilling data from at least three different offset wells in the drilling field associated with the selected well bore;

synthesizing the well logs and drilling data from the at least three different offset wells by processing the data to determine geological field trends in the drilling field and thereby generate synthesized field data for the well bore to be drilled in the drilling field;

evaluating the synthesized field data in a plurality of drilling contexts, wherein each drilling context is a geologic context or a well profile;

selecting at least one critical drilling context from the plurality of drilling contexts for predicting drilling performance, wherein the at least one selected critical drilling context includes a drilling context that affects the drilling performance more than at least one of other drilling contexts from the plurality of drilling contexts;

simulating the performance of at least two drilling devices in the at least one selected drilling context;

comparing the performance of the at least two drilling devices in the at least one selected drilling context;

selecting one of the at least two drilling devices for drilling the selected well bore based on the comparison of the simulated performance of the at least two drilling devices; and initiating drilling of the selected wellbore using the selected drilling device.

2. The method of claim 1 wherein the drilling device comprises a drill bit.

3. The method of claim 2 further comprising:

simulating the performance of a first drill bit in a selected drilling context;

simulating the performance of a second drill bit in the selected drilling context;

comparing the simulated performance of the first drill bit and the simulated performance of the second drill bit in the selected drilling context;

selecting either the first drill bit or the second drill bit based on the comparison of their respective simulated performances.

4. The method of claim 3 further comprising:

simulating the performance of a plurality of drill bits in the selected drilling context; and comparing the simulated performances of the plurality of drill bits in the selected drilling context.

5. The method of claim 2 further comprising:

simulating the performance of a first drill bit in a selected drilling context within the at least three different offset wells;

modifying at least one design parameter of the first drill bit; and simulating the performance of the modified drill bit in the selected drilling context within the at least three different offset wells.

6. The method of claim 5 further comprising the at least one design parameter selected from the group consisting of: number of blades, cutter type, bit profile, sharp slope, dull slope, friction slope, wear exponent, max work, initial contact area, and final contact area.

7. The method of claim 1 further comprising processing the well logs and drilling data to determine rock strength data.

8. The method of claim 7 wherein the selected drilling context comprises a selected rock strength interval.

9. The method of claim 1 further comprising processing the well logs and drilling data to determine plasticity data.

10. The method of claim 9 wherein the selected drilling context comprises a selected plasticity interval.

11. The method of claim 1 further comprising processing the well logs and drilling data to determine abrasivity data.

12. The method of claim 8 wherein the selected drilling context comprises a selected abrasivity interval.

13. The method of claim 1 wherein the well logs and drilling data comprises a plurality of formation types.

14. The method of claim 13 wherein the selected drilling context comprises a selected formation type.

15. The method of claim 1 wherein synthesizing the well logs and drilling data further comprises identifying at least one field trend.

16. The method of claim 15 wherein the at least one field trend further comprises variations in lithology.

17. The method of claim 15 wherein the at least one field trend further comprises variations in mechanical properties.

18. The method of claim 15 wherein the at least one field trend comprises variations in depth of formation.

19. The method of claim 15 wherein the at least one field trend comprises variations in formation thickness.

20. The method of claim 1 further comprising:

simulating the performance of at least two drilling devices in the at least one selected drilling context of the at least three different offset wells;

selecting a drilling device;

drilling the selected well bore using the selected drilling device;

obtaining lithology data of the drilled selected well bore; and synthesizing the lithology data from the drilled selected well bore with the well logs and drilling data from the at least three different offset wells to predict the drilling performances of a second selected well bore.

21. The method of claim 1 further comprising simulating the performance of the drilling device in the critical drilling context of the at least three different offset wells.

22. The method of claim 20 further comprising:

initiating drilling of the selected wellbore using a selected drilling device;

obtaining well logs and drilling data from the drilling of the selected wellbore in real time;

synthesizing the newly obtained well log data and drilling data with the well log data and drilling data from the at least three different offset wells; and selecting at least one modified drilling context for predicting drilling performance; and simulating the performance of a drilling device in the at least one modified drilling context.

23. A method for optimizing at least one drilling parameter to drill a selected well bore in a drilling field with a selected drilling device comprising:

obtaining well logs and drilling data from at least three different offset wells in the drilling field associated with the selected well bore;

synthesizing the well logs and drilling data from the at least three different offset wells by processing the data to determine geological field trends in the drilling field and thereby generate synthesized field data for the well bore to be drilled in the drilling field;

evaluating the synthesized data in a plurality of contexts, wherein each drilling context is a geologic context or a well profile;

selecting at least one critical drilling context from the plurality of drilling contexts for predicting drilling performance, wherein the at least one selected critical drilling context includes a drilling context that affects the drilling performance more than at least one of other drilling contexts from the plurality of drilling contexts; and simulating the performance of the drilling device in at least one selected drilling context in the at least three different offset wells using a first drilling parameter value;

simulating the performance of the drilling device in the at least one selected drilling context in the at least three different offset wells using a second drilling parameter value;

comparing the simulated performance of the drilling device using the first drilling parameter and using the second drilling parameter;

selecting either the first drilling parameter or the second drilling parameter based on the comparison of the simulated performance of the drilling device using the first drilling parameter and the second drilling parameter; and initiating drilling of the selected wellbore using the selected drilling parameter.

24. The method of claim 23 wherein the first drilling parameter value and the second drilling parameter value comprise a first weight on bit value and a second weight on bit value.

25. The method of claim 23 wherein the first drilling parameter value and the second drilling parameter comprises a first revolutions per minute (rpm) value and a second rpm value.

26. The method of claim 23 further comprising processing the well logs and drilling data to obtain rock strength data.

27. The method of claim 26 wherein the selected drilling context comprises a selected rock strength interval.

28. The method of claim 23 further comprising processing the well logs and drilling data to obtain plasticity data.

29. The method of claim 28 wherein the selected drilling context comprises a selected plasticity interval.

30. The method of claim 23 further comprising processing the well logs and drilling data to obtain abrasivity data.

31. The method of claim 30 wherein the selected drilling context comprises an abrasivity interval.

32. The method of claim 23 wherein the selected drilling context comprises a selected formation type.

33. The method of claim 23 wherein synthesizing the well logs and drilling data further comprises identifying at least one field trend.

34. The method of claim 33 wherein the at least one field trend further comprises variations in lithology.

35. The method of claim 33 wherein the at least one field trend further comprises variations in mechanical properties.

36. The method of claim 33 wherein the at least one field trend comprises variations in depth of formation.

37. The method of claim 33 wherein the at least one field trend comprises variations in formation thickness.

38. The method of claim 23 further comprising:

simulating the performance of a drilling device using the at least two drilling parameters in the at least one selected drilling context;

selecting a drilling parameter;

drilling the selected well bore using the selected drilling parameter;

obtaining well logs and drilling data of the drilled selected well bore; and synthesizing the well logs and drilling data from the drilled wellbore and the well logs and drilling data from the at least three different offset wells.

39. The method of claim 23 further comprising simulating the performance of the selected drilling device at the selected utilizing the selected drilling parameters in the critical drilling context of the at least three different offset wells.

40. The method of claim 23 further comprising:

initiating drilling of the selected wellbore using the selected drilling parameters;

obtaining well logs and drilling data from the drilling of the selected wellbore in real time;

synthesizing the newly obtained well log data and drilling data with the well log data and drilling data from the at least three different offset wells; and selecting at least one modified drilling context for predicting drilling performance; and simulating the performance of using the selected drilling parameters and modified drilling parameters in the at least one modified drilling context.

41. A system for optimizing the performance of a drilling device for drilling a selected well bore in a drilling field comprising :

a processing system having at least a processor and memory for executing instructions;

an input module operable to receive well logs and drilling data from at least three different offset wells in the drilling field associated with the selected well bore and to provide the data to a field synthesis module;

the field synthesis module operable to synthesize the well logs and drilling data from the at least three different offset wells by processing the data to determine geological field trends in the drilling field and thereby to generate synthesized field data for the well bore to be drilled in the drilling field;

a context analysis module operable to divide the synthesized field data into a plurality of selected drilling contexts, wherein each drilling context is a geologic context or a well profile;

a simulation module operable to simulate the performance of the drilling device in the at least three different offset wells in at least one selected critical drilling context selected from the plurality of selected drilling contexts, wherein the at least one selected critical drilling context includes a drilling context that affects the drilling performance more than at least one of other selected drilling contexts from the plurality of selected drilling contexts; and an output module configured to display information regarding the simulated performance of the drilling device in the at least three different offset wells in the at least one selected drilling context.

42. The system of claim 41 wherein the input module further comprises:

a well log analysis module operable to process the well log; and a mechanical properties module operable to determine the mechanical properties of the at least three offset wells.

43. The system of claim 41 further comprising the simulation module operable to simulate the performance of the drilling device in the at least three offset wells in a selected critical drilling context.

* * * * *